United States Patent [19]

Baugh

[11] 4,401,164

[45] Aug. 30, 1983

[54] IN SITU METHOD AND APPARATUS FOR INSPECTING AND REPAIRING SUBSEA WELLHEADS

[76] Inventor: Benton F. Baugh, 14625 Oak Bend, Houston, Tex.

[21] Appl. No.: 256,999

[22] Filed: Apr. 24, 1981

[51] Int. Cl.[3] ..... E21B 17/01; E21B 17/02; E21B 41/04

[52] U.S. Cl. ..... 166/379; 166/339; 166/349; 166/359; 166/362; 166/367; 285/137 A

[58] Field of Search ..... 166/379, 79, 359, 360, 166/362, 367, 350, 341, 338, 339, 349; 175/85; 414/22; 173/152, 160; 285/137 A; 182/148, 141, 145, 146; 187/6

[56] References Cited

U.S. PATENT DOCUMENTS

| | | | |
|---|---|---|---|
| 1,474,249 | 11/1923 | Ferrero | 182/145 X |
| 2,803,503 | 8/1957 | Borgman et al. | 182/145 X |
| 3,256,956 | 6/1966 | Puhringer | 182/141 X |
| 3,324,943 | 6/1967 | Price | 166/359 X |
| 3,782,458 | 1/1974 | Slack | 166/359 X |
| 3,895,677 | 7/1975 | Bokenkamp | 166/359 |
| 3,913,668 | 10/1975 | Todd et al. | 166/359 |
| 4,047,579 | 9/1977 | Wilckens et al. | 166/350 X |
| 4,068,737 | 1/1978 | Lenz | 182/146 X |
| 4,119,145 | 10/1978 | Tuson | 166/360 X |

FOREIGN PATENT DOCUMENTS

| | | | |
|---|---|---|---|
| 2813119 | 10/1978 | Fed. Rep. of Germany | 285/137 A |
| 2833866 | 2/1980 | Fed. Rep. of Germany | 285/137 A |

*Primary Examiner*—Stephen J. Novosad

*Attorney, Agent, or Firm*—Pravel, Gambrell, Hewitt, Kirk & Kimball

[57] ABSTRACT

A marine riser having a pair of hydraulic lines, such as choke and kill lines, secured thereto and substantially parallel to one another providing track means extending along substantially the full length of a multiple joint riser string for transporting a carriage along the riser from near the top to the bottom. The invention also includes a carriage adapted to travel along such track and also includes television camera and lights as well as manipulator means for performing various functions on a blow-out preventer stack and wellhead connector as well as associated equipment positioned at the lower end of the marine riser.

25 Claims, 16 Drawing Figures

30
3
3
33
40
4
4
45
44
44
43
5
5
C
K"
C"
53
52
6
6
20

K"
C"
C
50
57'

57'
58
72
C''
75
73
59
57
70a
62
63
75
70
60a
70b
60
55
56
61
29a
29c
C'''
C
K
B
C'''
29
25a
29c
28a
E
Ka
25b
28b
W
M

IN SITU METHOD AND APPARATUS FOR INSPECTING AND REPAIRING SUBSEA WELLHEADS

BACKGROUND OF THE INVENTION

Problems of inaccessability for inspection and/or repair inherent in the installation and operation of subsea wellheads are exacerbated as water depths increase, particularly, when wellheads are installed beyond normal diver depths. While remote television cameras provide some view of the wellhead and blow-out preventer stack, present systems do not include means for mounting and precisely positioning a mobile work module adjacent to the blow-out preventer stack. Thus, in many instances, it is necessary to pull the subsea riser to retrieve the blow-out preventer stack to effectuate the repairs thereto. Similarly, should the Ax seal between the wellhead and the wellhead connector fail, it is necessary to retrieve the riser string to substitute a new Ax seal.

SUMMARY OF THE INVENTION

The present invention employs conventional choke and kill lines or other external conduits, such as a hydraulic line or a booster line, secured to a production or drilling a riser string to provide a track system for conveying a mobile module or carriage to a selected position adjacent to the blow-out preventer stack or wellhead. Such track and manipulator carriage provides a means for transporting a television camera, lights and means for executing certain manipulations to repair or restore components of the blowout preventer stack or to remove and install a new Ax seal between the wellhead and the wellhead connector without the necessity of pulling the riser stack for retrieving the blowout preventer and wellhead connector to the surface. The track system and associated work module also provide means for replacing control pods, replacing electric lines, sonar packages as well as means for re-energizing seals on gate valves. Additionally, a full inspection of the blow-out preventer stack with remote television cameras and lights may be accomplished via the mobile module system.

DESCRIPTION OF THE PREFERRED EMBODIMENT

Figure 1A:
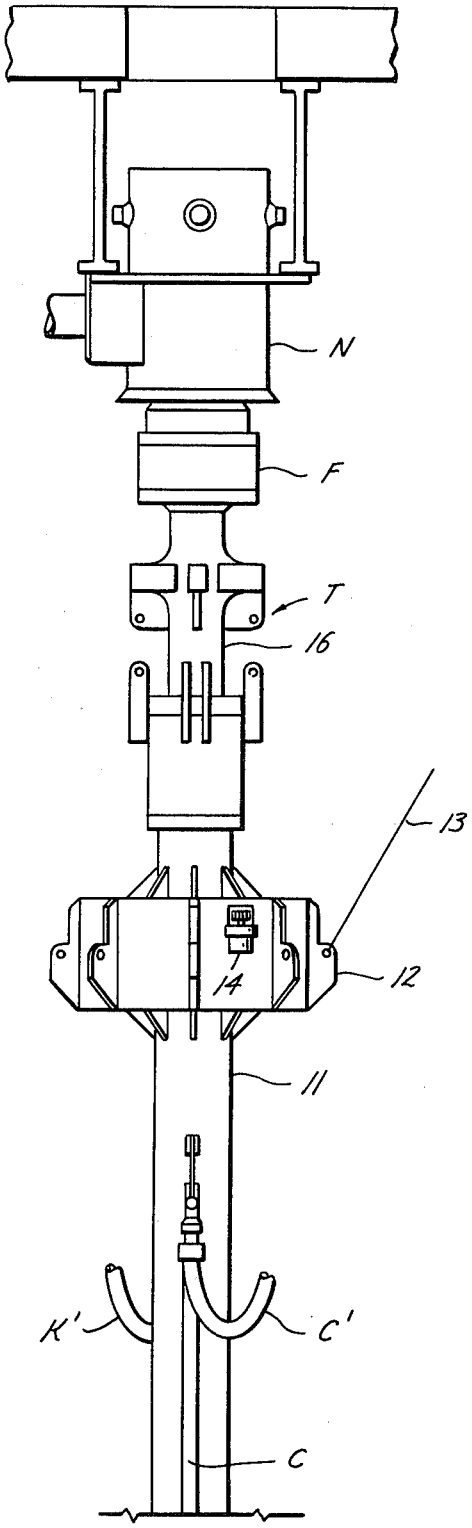
FIG. 1*a* is a partial side view of the upper portion of a sub-sea riser.

As shown in drawings, a marine riser R extends from near the water surface down to a blow-out preventer stack B which is positioned on a wellhead W situated adjacent to the mud line M at the water bottom. Such riser includes choke and kill lines, C and K, respectively, which are positioned on opposite sides of the marine riser R to form parallel tracks to receive the mobile carriage E. As will be explained in detail, the carriage E includes a television camera and lights as well as manipulator means for performing certain functions with respect to the blow-out preventer stack and/or wellhead. Such mobile carriage E can be moved along the riser R on the track formed by the choke and kill lines C and K and particularly can be moved into position adjacent the blow-out preventer stack to provide a view of the blow-out preventers via remote television camera mounted in the carriage and also to enable the remotely operable manipulator mounted on the carriage E to perform certain functions. The riser R includes an upper or telescopic joint T which is secured to a flexible joint F that is connected to a flexible bell nipple N supported beneath the rotary table on the rig.

The lower or outer barrel 11 of the telescopic joint T is supported by a tensioner ring assembly 12 that is carried by a plurality of cables 13. A reversible hydraulic motor 14 is mounted on the tension ring 12. This reversible motor drives a ring gear on the riser R and causes the riser to rotate relative to the upper inner section 16 tensioner T as well as to the flexible joint F and fixed bell Nipple N thereabove.

The choke and kill lines, C and K, are connected to a choke and kill manifold (not shown) by flexible hoses C′ and K′. Such flexible hoses accommodate the movement in the telescopic joint T.

Figure 1B:
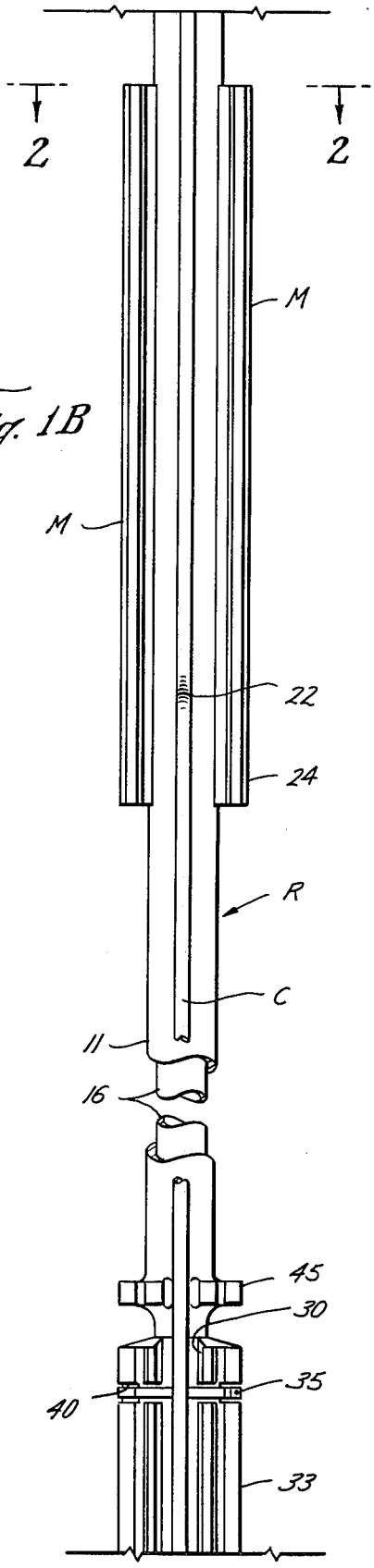
FIG. 1*b* is a side elevation of a next intermediate portion of a sub-sea riser.
Figure 2:
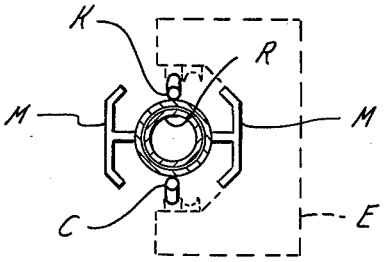
FIG. 2 is a sectional view taken on line 2—2 of FIG. 1*b;*
Figure 5:
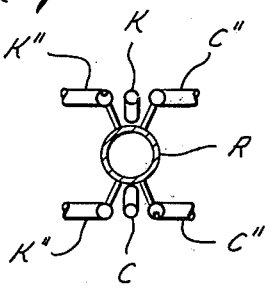
FIG. 5 is a sectional view taken on line 5—5 of FIG. 1*c;*

The rigid choke and kill lines C and K, respectively, are secured to the riser pipe R. Such choke and kill lines are bent inwardly toward the riser R and then bent or turned downwardly parallel to the sides of the riser as shown at 20 (FIG. 6) and as further illustrated in FIGS. 5 and 6. This configuration of the choke and kill lines releases the primary wheels of the carriage as it passes onto the shunt tracks, as will be described in more detail. As shown in FIG. 1*b* carriage guide flanges M are mounted on the riser R immediately above the outward bend 22 in the choke and kill lines C and K. The carriage guide flanges M provide means for aligning the carriage E with the tracks formed by the choke and kill lines. The guide comprises a pair of longitudinally extending flanges, one on either side of the riser pipe, each having a "T" shaped configuration with the outer ends of the crossbar of the "T" shaped member being turned inwardly toward the riser pipe R as shown in FIG. 2. The guide flange M is preferably slightly longer than the carriage E and the lower end of the guide overlaps the outer portion of the choke and kill lines, C and K, at 24 to facilitate alignment of carriage E with the choke and kill lines during installation.

Figure 1C:
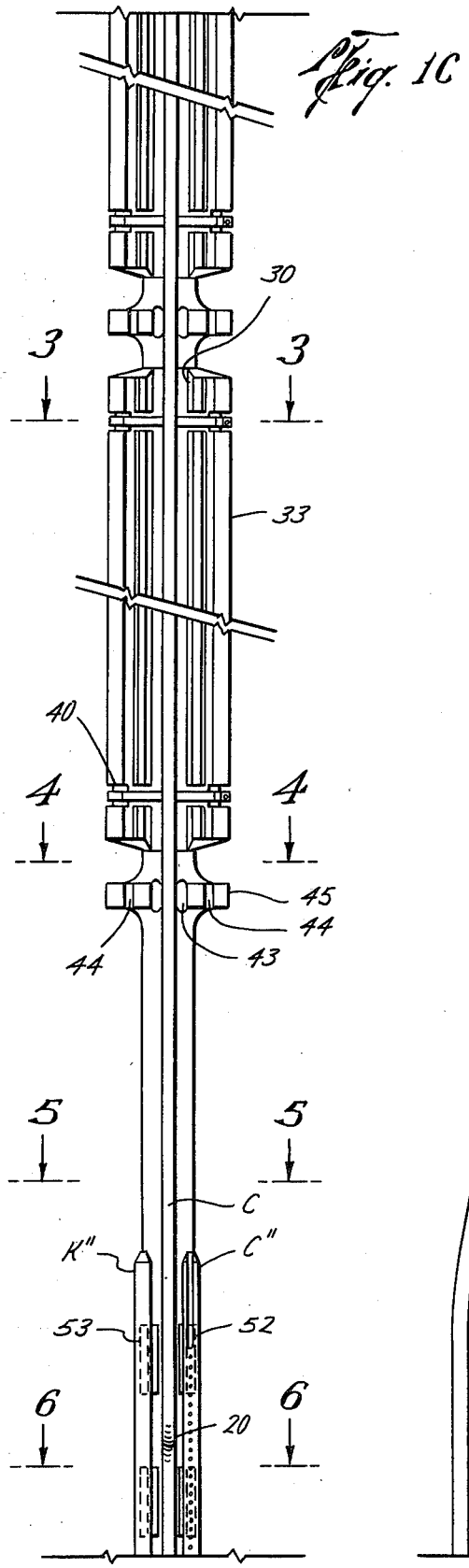
FIG. 1*c* is a side view of the portion of a sub-sea riser beneath FIG. 1*b;*
Figure 1D:
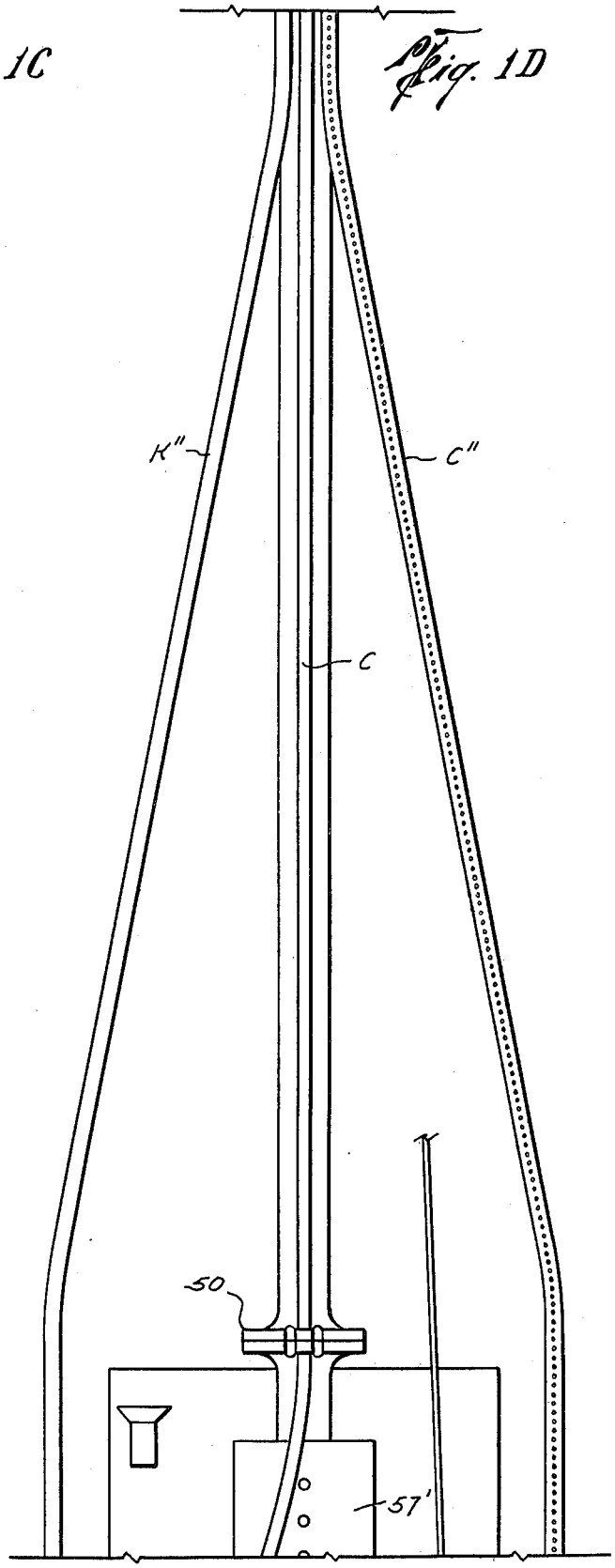
FIG. 1*d* is a next portion of the subsea riser beneath FIG. 1*c;*.
Figure 1E:
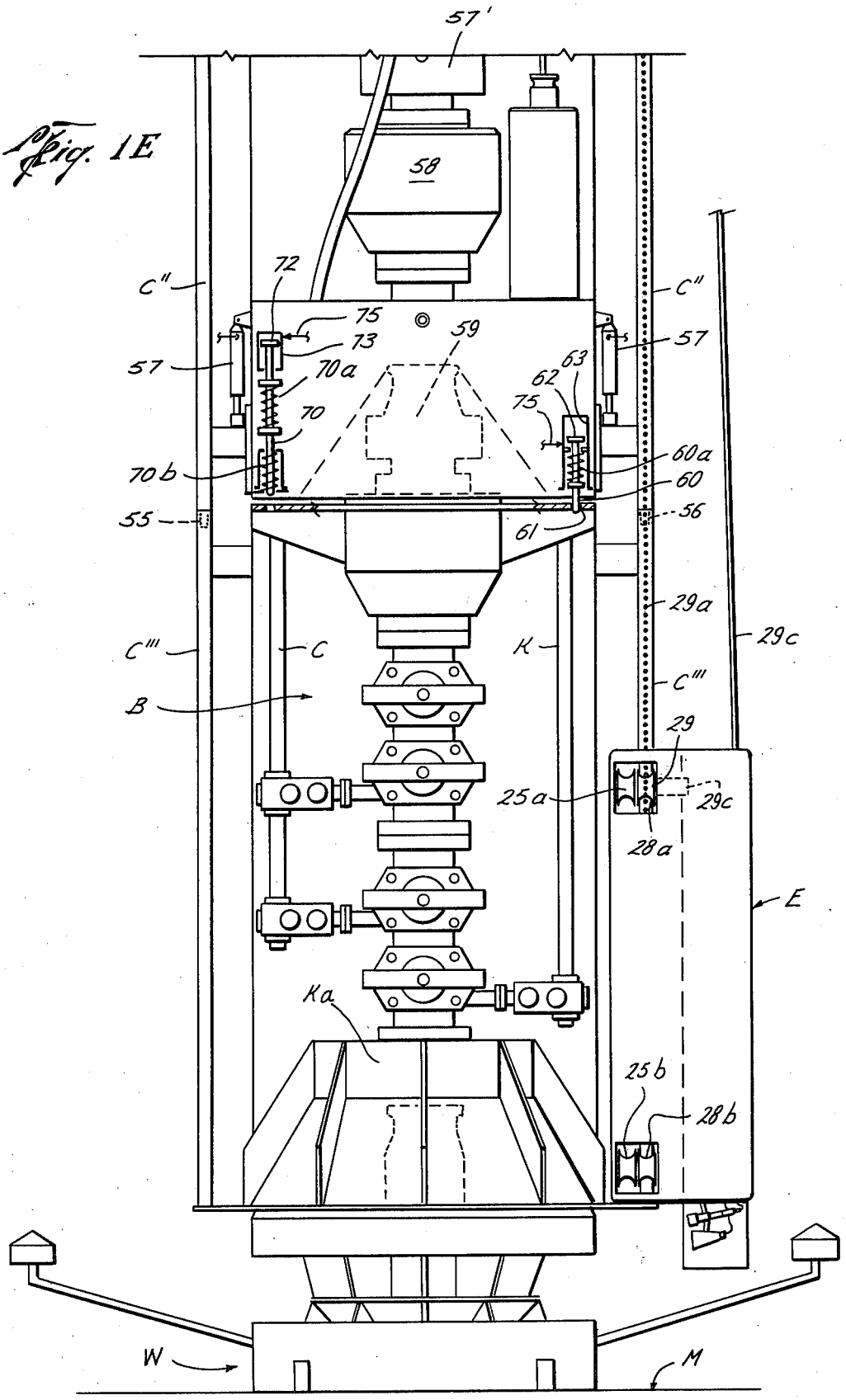
FIG. 1*e* is an elevation of the lower portion of the subsea riser including the blowout preventer stack in the wellhead.

As seen in FIG. 1E, the carriage E has a pair of inner wheels 25*a* and 25*b* which engage the choke or kill lines C or K, respectively, as the case may be and another pair on the opposite side of the carriage which engage the other of the choke or kill lines. Also an outer pair of wheels 28*a* and 28*b* engage the shunt tracks C″ and K″. The ends of the shunt tracks overlap the choke and kill lines C and K, respectively, at 20 to facilitate guidance of the carriage E from the choke and kill track to the shunt tracks. The wheels 28*a* and 28*b* have radially extending pins 29 for engaging longitudinally spaced openings 29*a* in the shunt tracks for providing non-slip engagement of the tracks for accurately positioning the carriage relative to the BOP stack. Motor drive means 29*c* drives the wheel 28*a* to assist in moving the carriage, which is also supported by cable 29*c*.

Figure 3:
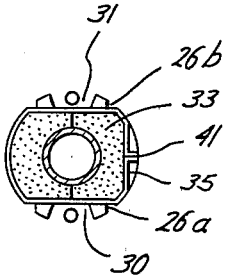
FIG. 3 is a sectional view taken on line 3—3 of FIG. 1*c;*
Figure 4:
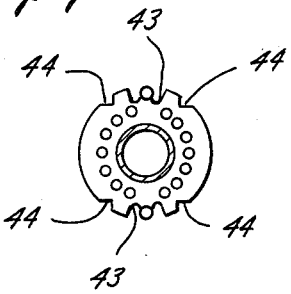
FIG. 4 is a sectional view taken on line 4—4 of FIG. 1*c;*

The choke and kill lines pass through longitudinally extending grooves 30 and 31 in the buoyant riser joints 33, which joints are formed of syntactic foam or other suitable buoyancy material. As shown in FIG. 3 the syntactic foam material is formed of two pieces which are split longitudinally and strapped to the riser R by means of stainless steel straps 35. In this arrangement the stainless steel straps extend through openings in the syntactic foam blocks 33 and pass between the riser R and the choke and kill lines so as not to interfere with passage of the primary carriage wheels 25*a* and 25*b* by passing along the choke and kill line tracks and longitudinal slots 26*a* and 26*b* are provided to receive the outer wheels 28*a* and 28*b* of the carriage E.

A suitable relief area or horizontal groove 40 is formed in the syntactic foam block to receive the stainless steel straps and their respective locking means 41. Similarly, the flanges 45 on the joints of riser pipe R are provided with suitable grooves 43 and 44 for receiving the primary wheels and the secondary wheels of the carriage as the carriage passes over the flanges 45.

Figure 6:
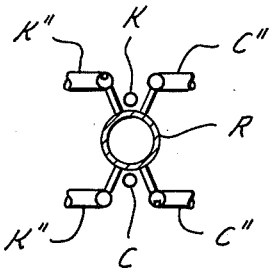
FIG. 6 is a sectional view taken on line 6—6 of FIG. 1*c;*
Figure 7:
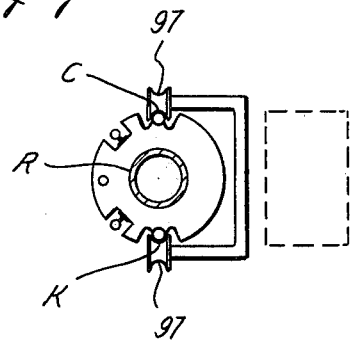
FIG. 7 is a schematic view showing a carriage on the hydraulic lines of FIG. 8.

As shown in FIGS. 1C and 6 the choke and kill lines are bent inwardly at 20 and extend along the riser to the lower flange 50 thence to the blow-out preventer stack. The upper end of the shunt track C″ and K″ extend above the bend 20 and thus overlap a portion of the choke and kill lines C and K. Thus both the primary wheels 25*a* and 25*b* and the outer wheels 28*a* and 28*b* will be on their respective tracks momentarily before the primary wheels disengage the choke and kill lines as they bend away from the path of the shunt tracks C″ and K″. As shown in FIGS. 1C, 1D and 1E, there are two sets of shunt tracks, one on each side of the riser pipe R to permit the carriage C to be run to either side of the blow-out preventer stack to provide a view of either side. The upper ends of the shunt tracks C″ and K″ are provided with slip joint mountings 52 and 53 to enable the shunt tracks to be moved longitudinally relative to the riser or the blow-out preventer stack. The lower end of the movable portion of the shunt track is also provided with a slip joint mounting at 56 to permit longitudinal movement of the track relative to the riser. Hydraulic cylinders 57 are provided for moving the tracks C″ and K″ upwardly and downwardly to withdraw the pins 55 from the fixed section of shunt track C‴ rigidly secured to the blow-out preventer stack and also to re-insert such pins when desired.

As shown in FIG. 1*e* the lower marine riser package at the lower end of the riser R includes a flexible joint 57′, a hydraulic connector 58 and a swivel assembly 59, all of which are well known in the art.

The hydraulic connector 58 includes a primary orientation pin 60 which projects below the bottom of the hydraulic connector and extends into an orientation opening 61 in the top of the blow-out preventer housing. The pin 60 is biased in a downward direction by a spring 60*a*. The upper end of the pin 60 includes a hydraulic piston 62 which is received in a cylinder 63. The hydraulic connector also includes a secondary orienting pin 70 which is disposed on the opposite side of the hydraulic connector from the primary pin 60. The secondary pin has a first spring 70*a* which biases the pin upwardly and a second, weaker spring, 70*b* which biases downwardly. The second pin is provided with a hydraulic piston 72 which is received in hydraulic chamber 73. A common source of hydraulic fluid 75 is connected both to primary pin 60 and secondary pin 70. When actuated, the hydraulic fluid raises the primary pin 60 and depresses the secondary pin 70, thus permitting rotation of the hydraulic connector 58 about the swivel assembly 59. When the secondary pin is oriented in alignment with the orientation hole or opening 61, the pin 70 will be moved into the hole by spring 70*a* and remain in this position as long as the hydraulic fluid pressure is held on pistons 62 and 72. When such pressure is released, the spring 70*b* overcomes the weaker spring 70*a* and withdraws the pin from the opening, thus permitting rotation of the riser and the shunt tracks C″ and K″ supported thereon relative to blow-out preventer stack. After the riser has rotated 180° and the orientation pin 70 is inserted into the opening 61, the shunt tracks C″ and K″ are moved downwardly and the pins 55 are inserted into the rigid shunt tracks C‴. Thereafter, the manipulator carriage E will be lowered into position on either side of the blow-out preventer stack, as the case may be. It is understood that the manipulator carriage E is moved up to a position above the pin connector 56 and onto the track C″ K″ and is rotated to the opposite side of the BOP stack with such track. After the tracks C″ and K″ have been reconnected with tracks C‴ and K‴ the carriage E is lowered onto the rigid track portion C‴ K‴ adjacent the BOP stack.

Figure 10:
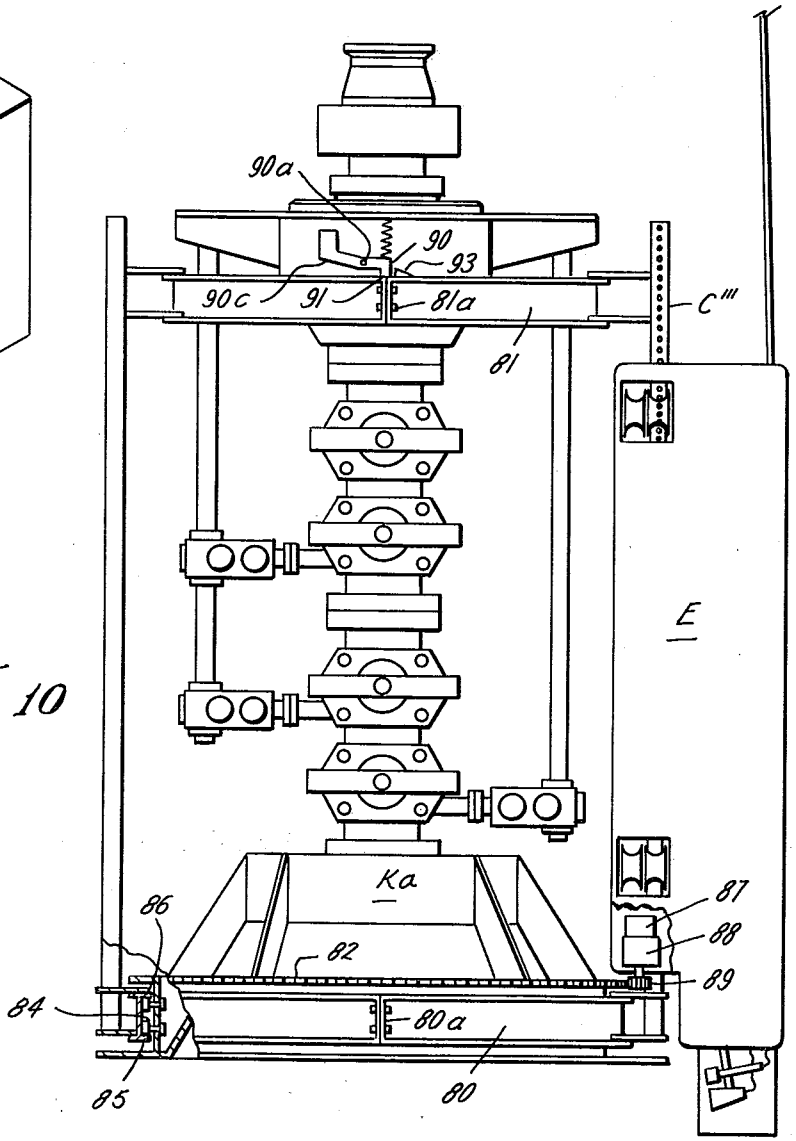
FIG. 10 is a side view of a blowout preventor stack with means for rotating the carriage about such stack.

An alternate embodiment is shown in FIG. 10 wherein the rigid portion of the shunt track C″ and K″ is mounted on upper and lower spaced rotatable rings 80 and 81 which are half circles bolted or otherwise secured together at 80*a* and 81*a*. These rotatable rings are of a sufficient circumference to clear the blow-out preventer stack and yet position the manipulator carriage in close enough proximity to enable the manipulator to perform work functions on the blow-out preventer stack.

Figure 9:
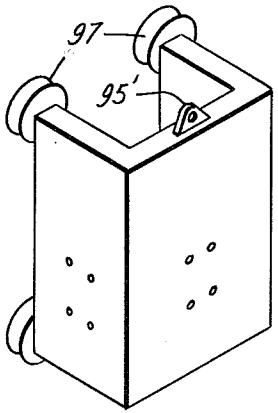
FIG. 9 is an isometric view of the manipulator carriage.
Figure 8:
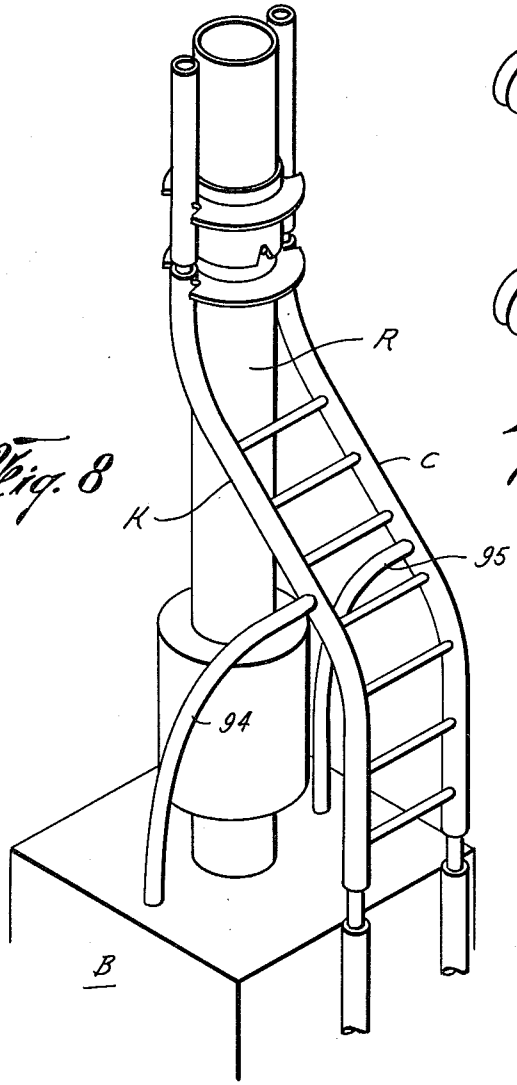
FIG. 8 is an isometric view of choke and kill line track of an alternate embodiment of the present invention.

A large spur gear 82 is formed on the outer flange of a spur gear base which is affixed to the wellhead connector K. A plurality of circumferentially spaced cam follower bearings 84 are secured to the spur gear base 82*a* and are spaced to engage the upper and lower flanges 85 and 86 of the lower rotatable ring 80. The hydraulic motor 87 and gear reducer 88 are mounted with the manipulator carriage E and include a drive gear 89 for engagement with the spur gear 82. An orientation key 90 is provided for engaging either of two slots 91 formed in the upper rotating ring 81 180° apart. Inclined shoulders 93 are on either side of the slot 91. Th orienting key 90 is pivotally mounted on pin 90*a* carried on guide plate 90*b*. The orienting key includes pivot arm 90*c* and engagement lug 90*d* which is actuated to release the key 90 and permit rotation of the rings 80 and 81 on which the rigid track C''' bearing the manipulator carriage E is mounted. With this arrangement, the manipulator carriage E can be positioned on the rigid track C''' and K''' and rotated about the blow-out preventer stack to provide a continuous view of the entire circumference of the BOP stack. Another alternate embodiment is shown in FIGS. 8 and 9 wherein the choke and kill lines C and K are secured on opposite sides of the riser R and extend down beside the BOP stack shown schematically as B. Choke and kill line spurs 94 and 95 extend to the BOP stack to provide the choke and kill functions and the lines C and K combine to provide a track means transporting the carriage as shown in FIG. 9 down beside the BOP stack. This carriage is lowered by cable which connects by 95' and is equipped with a TV camera, lights and other equipment such as the carriage M shown with the other embodiment. One or more wheels 97 may be driven by suitable drive means, if desired.

Figure 11:
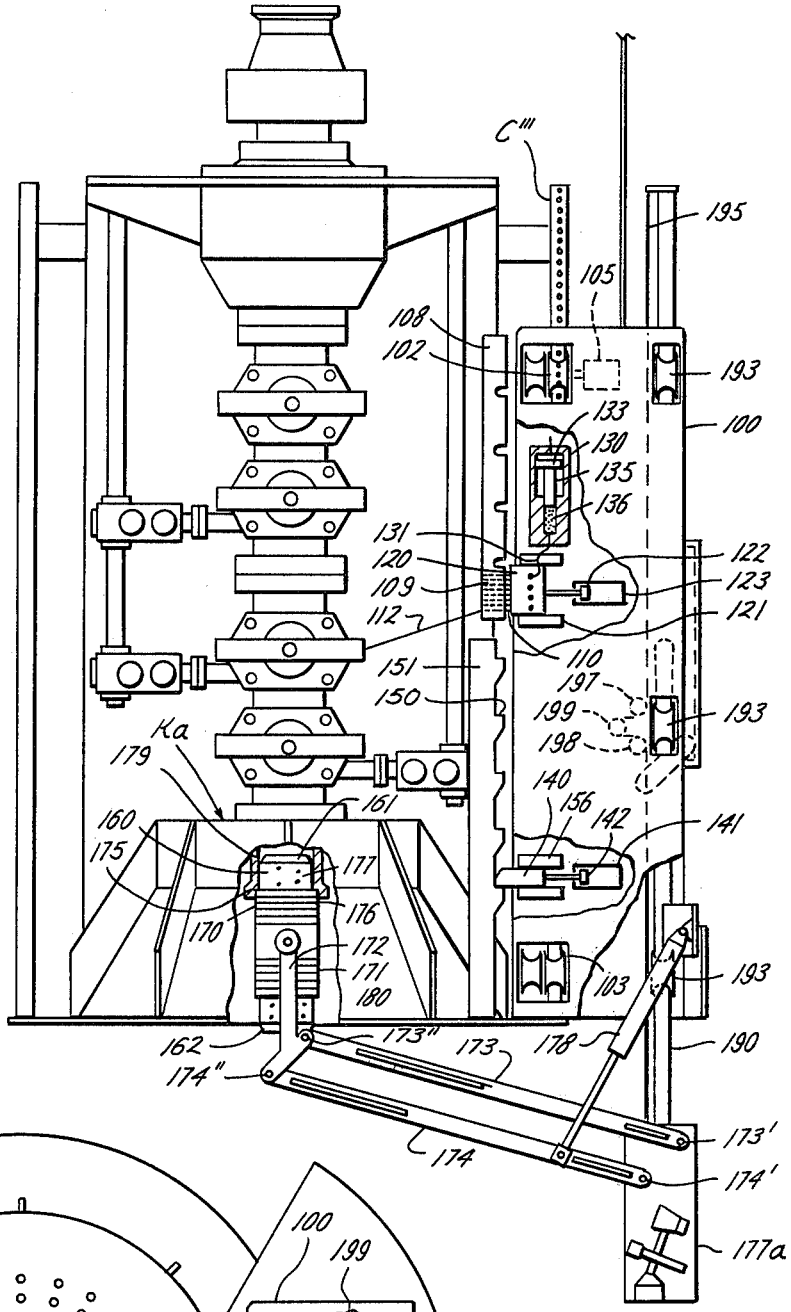
FIG. 11 is a side elevation partially in section of a manipulator carriage with the manipulator positioned beneath the lower end of the wellhead connector.
Figure 12:
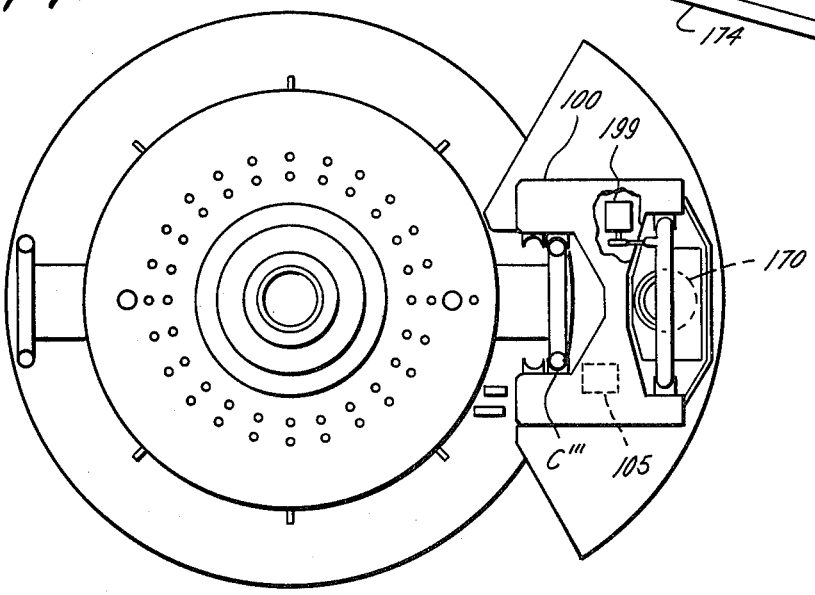
FIG. 12 is a top view of the blowout preventer stack and the manipulator carriage illustrated in FIG. 11.

As shown in FIGS. 11 and 12, the manipulator M comprises a housing 101 which mounts two or more sets of wheels 102 and 103. The upper wheel set 102 is driven by reversible motor 105 for moving the manipulator carriage up and down the track C''', as desired.

A hydraulic stab plate 108 is secured to the blowout preventer stack by any suitable means and such stab plate extends vertically from top to the bottom of the stack and is provided with a plurality of longitudinally spaced openings or receptacles 109 for receiving hydraulic stabs 110 which are mounted in the manipulator carriage.

The hydraulic stab receptacles are connected by conduits 112 to various components in the blow-out preventer stack, i.e., the circumferentially spaced dogs or detents 175 which retain the Ax gasket 176 in the wellhead connector Ka. By way of further example, such pressure conduits also connect to various preventer bodies to enable the valves to be reenergized.

The hydraulic stab assembly includes a block 120 which is slideably mounted in ways 121 and a reciprocating hydraulic piston 122 and cylinder 123 for moving the block 120 and the stab probes 110 into and out of their respective receptacles.

Further, a sealant pressure intensifier 130 is also provided in the carriage M. The outlet of the intensifier is connected to the stab assembly via high pressure conduit 131. The intensifier comprises a hydraulic piston having a large end 13 and a small piston end 135. The bore 136 also contains a supply of sealant material which is communicated by a high pressure hydraulic conduit 131 to the appropriate seals in the blow-out preventor stack. A drive pressure conduit communicates with the large end of the piston to provide hydraulic pressure for moving the large piston and the small piston connected thereto to pressurize the sealant material and the counter bore, and supply it under pressure to the appropriate receptacle. It will be appreciated that with this arrangement sealant can be replenished or valves re-energized, from time to time, as desired without retrieving the blow-out preventer stack.

Also as shown in the drawings, blow-out preventer stack is provided with a hydraulic stab plate which makes provision for a number of receptacles which are positioned for receiving the probes 110 of the block 120. Thus, by aligning the carriage in a particular position, the hydraulic probes may be inserted into any selected set of receptacles 110 to provide access to a plurality of functions or manipulations or tests on the various parts of the blow-out preventer stack.

An indexing key 140 which is hydraulically operable by means of the cylinder 141 and piston 142 is adapted to be projected out to engagement with one of a number of longitudinally spaced notches or shoulders 150 on an index plate 151 which is mounted on the blow-out preventer stack. The reciprocating hydraulic piston 142 is connected to the detent or key which is slide mounted for reciprocal movement in the ways 156 to enable the indexing key to be moved outwardly to engage one of the shoulders 150. With this indexing key the carriage E can be positioned accurately relative to the blow-out preventer stack and thereby facilitate proper alignment of a hydraulic stab assemblies with the selected set of receptacles 109, the shoulders 150 being spaced vertically to correspond to the verticle spacing of the various sets of hydraulic recepticles 109.

Also shown in FIGS. 11 and 12 of the drawings is the manipulator for replacing the Ax gasket in the wellhead connector Ka. The manipulator comprises a rotatably mounted cylindrical housing 160 having tapered ends or shoulders 161 and 162 to facilitate guiding the cylinder into the opening of the wellhead connector for receiving the Ax gasket. Further, cylindrical housing is provided with a plurality of circumferentially spaced sets of spring-loaded dogs which retain Ax gaskets on the cylinder. As shown, Ax gaskets 170 are positioned on the upper portion of the cylinder and Ax gaskets 171 are positioned on the lower portion of the cylinder. Typically, new gaskets are stored on one end of the cylindrical housing or gasket carrier and used or replaced gaskets are stored on the opposite end.

The rotatable cylinder 160 is rotatable about a transverse axis which extends through the central portion of the cylindrical housing. Such housing is rotatably mounted on arms 172 which are pivotally carried by a pair of support arms 173 and 174 on either side of the cylindrical housing. The pivotal support arms are mounted on pivot pins 173' and 174' on a support housing 177*a* and the support arm for the cylindrical housing is mounted by pivot pin 113'' and 114''. A hydraulic cylinder 178 is provided for pivoting the support arms 113 and 114 to align the cylindrical housing 160 with the central opening 179 in the wellhead. The support arms also include a hydraulic motor which rotates the cylindrical housing 180° (indicated by arrow 180) to present either end of the cylindrical housing to the downwardly facing opening in the wellhead connector which receives the Ax gasket.

The support housing is carried on a pair of substantially parallel shafts 190 which extend through the manipulator carriage E and which are guided by vertically spaced rollers 193. A chain 195 is secured to one of the shafts and such chain extends over idler gears 197 and 198 and over a sprocket on drive motor 199 which provides means for raising and lowering the support housing 177*a* relative to the manipulator carriage E. The support housing 177*a* also mounts the TV camera, sonar and lights. Thus, providing means for viewing the removal of one Ax gasket and the installation of another and the downwardly facing open end of the wellhead connector as will be described herein.

With the arrangement shown in FIGS. 11 and 12, a pair of new Ax gaskets may be carried on one end of the cylindrical housing 160 and retained thereon by the spring-loaded dogs 177.

The cylindrical housing 160 is stored between the spaced support shafts 190 in the manipulator carriage E. When it is desired to remove and replace an Ax gasket, the wellhead connector is disconnected from the wellhead and lifted as substantial height above the wellhead to permit access by the manipulator beneath the downwardly facing well head connector. The hydraulic motor 199 is actuated to drive the support shafts 190 downwardly carrying the pivotally mounted manipulator therewith. When the manipulator has been extended a sufficient distance beneath the wellhead connector to permit retraction of the cylindrical housing from its vertical position, it is pivoted downwardly and outwardly by means of the hydraulic cylinder 178 and positioned with the cylindrical housing aligned in a vertical position beneath the downwardly facing opening 179 in the wellhead connector in which the Ax gasket is received. The motor 199 is then reversed and the support housing raised to move the cylindrical housing vertically upward into position in the downwardly facing wellhead connector opening and with it thus positioned the hydraulically actuated detents or dogs 175 which normally retain the Ax gasket in place in the wellhead connector are released. The Ax gasket which is now held is retained on the cylindrical housing by the dogs 177 may be withdrawn from the lower end of the wellhead connector simply by lowering the cylindrical housing. After the cylindrical housing has been lowered a sufficient distance below the wellhead connector to provide space for rotation of the cylindrical housing, it is rotated 180° and presents a new Ax gasket which may then be inserted into the downwardly facing opening 179 in the wellhead connector. The motor 199 is actuated and the now reversed cylindrical housing is raised and the tapered shoulder guide end is inserted back into the central opening and the Ax gasket aligned so that its retaining groove M is positioned adjacent the detents or dogs 175 and thereafter such dogs are hydraulically actuated to secure the Ax gasket in place in the lower end of the wellhead connector.

Thereafter, the manipulator is lowered, pivoted back into vertical position and raised into its nested or storage position in the manipulator carriage. The wellhead connector is then lowered onto the wellhead with the new Ax gasket in place.

With this arrangement two or more Ax gaskets can be replaced in the wellhead connector without the necessity of pulling the entire riser string to the surface.

I claim:

1. In a marine riser having external hydraulic lines extending along the riser, the improvement comprising mounting means securing at least two such hydraulic lines to the riser substantially parallel to each other; said mounting means providing clearances adjacent to said hydraulic lines to provide substantially unobstructed guidance track means along the riser joint and from one riser joint to another for receiving a carriage adapted to run on such track means.

2. The invention of claim 1, wherein said riser comprises a plurality of riser joints having end flanges for connection together end to end and wherein said flanges have circumferentially spaced slots having clearances adjacent to said hydraulic lines to provide substantially unobstructed guidance along said hydraulic lines.

3. In a marine riser having external hydraulic lines extending along the riser, the improvement comprising securing at least two such hydraulic lines to the riser substantially parallel to each other forming substantially unobstructed track means along the riser joint and from one joint to another for receiving a carriage adapted to run on such tracks, and carriage means adapted to run on such hydraulic line track for travel along the exterior of the riser, and means for moving such carriage along such track.

4. The invention of claim 3, wherein said carriage means include spaced wheels having concave surfaces for engaging said track means.

5. The invention of claim 4, wherein at least one of said secondary wheels has a plurality of projections extending radially therefrom and wherein said shunt track means has longitudinally spaced openings for receiving said projections to provide non-slip engagement between said wheel and said track means.

6. The invention of claim 3, wherein said carriage means includes spaced wheels positioned to engage opposite outer surfaces of the parallel track means.

7. The invention of claim 3, including longitudinally extending guide means secured to said riser adjacent said hydraulic line track means for aligning said carriage means with said track means.

8. The invention of claim 7, wherein said guide has a "T" shaped cross-section with the ends of the bar portion of said "T" being inclined toward the riser.

9. The invention of claim 3, wherein said carriage has a plurality of wheels for mounting on said hydraulic line track means and wherein said riser includes buoyant riser joints having longitudinally extending slots for receiving the wheels of said carriage.

10. The invention of claim 3, wherein said shunt tracks are slidably mounted relative to said riser and include means for moving said shunt tracks longitudinally along said riser.

11. The invention of claim 3, including a blow-out preventer stack at the lower end of said riser with a longitudinally extending hydraulic stab plate secured adjacent to the blow-out preventer stack and having a plurality of receptacles therein for connection to hydraulic control lines adapted to be connected to various components in the blow-out preventer stack and a movable hydraulic stab assembly mounted on said carriage means including a plurality of hydraulic stabs adapted to be stabbed into said receptacles and means for moving said hydraulic stabs into and out of engagement with said receptacles.

12. The invention of claim 3, wherein said carriage includes a movable support member having a gasket carrier means supported thereby with means for moving said gasket carrier means to insert an Ax gasket carried thereby into the central opening in said wellhead connector.

13. The invention of claim 3, wherein said carriage includes a movable support member having pivotally mounted arms thereon with a rotatable gasket carrier supported thereby which mounts one or more Ax gaskets and is adapted for insertion into the opening at the lower end of the wellhead connector for inserting or removing an Ax gasket therefrom with means for pivoting said pivotal arms to raise and lower said gasket carrier relative to said wellhead connector and means for rotating said gasket carrier to present either end thereof to the opening in the wellhead connector.

14. In a marine riser having external hydraulic lines extending along the riser, the improvement comprising securing at least two hydraulic lines to the riser substantially parallel to each other forming substantially unobstructed track means along the riser joint and from one joint to another for receiving a carriage adapted to run on such tracks and shunt track means associated with said hydraulic line tracks to provide an extension of said hydraulic line track means beyond such hydraulic lines.

15. The invention of claim 14, wherein said carriage means include a pair of primary wheels for engaging said line track means and a pair of secondary wheels for engaging said shunt tracks.

16. The invention of claim 14, wherein said shunt track means includes one or more movable portions movable longitudinally relative to said riser, two or more fixed portions of said track adjacent the blow-out preventer stack; and, means for rotating the marine riser and movable portions of shunt track relative to the fixed portion of said track to align the movable portion with a fixed portion thereof.

17. The invention of claim 16, wherein at least one of said pair of secondary wheels has shunt track engaging means and said shunt track has engagement means to provide positive engagement between said wheels and the track.

18. The invention of claim 17, including a sealant pressure intensifier connected to one of the hydraulic stabs for communicating sealant under high pressure to various components of the blow-out preventer stack and means for pressurizing said sealant as it is communicated to the blow-out preventer stack.

19. The invention of claim 14, wherein said shunt track means includes a first movable portion movable longitudinally relative to said riser and a second movable portion movable circumferentially of the blow-out preventer stack and means for moving said second movable portion to rotate it about the blow-out preventer stack.

20. The invention of claim 14, wherein said shunt track means includes a movable portion movable circumferentially of a blow-out preventer stack positioned at the lower end of a marine riser and means for moving such movable portions circumferentially of the blow-out preventer stack.

21. A marine riser connector having a flanged portion with spaced openings in the outer circumference thereof to allow unobstructed track means to extend along the axis thereof and spaced clearances adjacent to said openings in said flanged portion to allow substantially unobstructed guidance along said track means.

22. In a marine riser having external hydraulic lines extending along the riser, the improvement comprising securing at least two hydraulic lines to the riser substantially parallel to each other forming substantially unobstructed track means along the riser joint and from one joint to another for receiving a carriage adapted to run on such tracks, said carriage has a plurality of wheels adapted to mount on said hydraulic line track means and said riser comprises a plurality of riser joints having end flanges for connection together end to end and wherein said flanges have circumferentially spaced slots providing openings through said flanges for passage of said carriage wheels running on said track means.

23. A manipulator carriage adapted for mounting on a pair of spaced substantially parallel tubular tracks, said carriage having a plurality of opposing wheels each engaging said tracks with substantially concave surfaces, said engagement being on substantially opposite sides of said tracks.

24. In a marine riser having external hydraulic lines extending along the riser, the improvement comprising securing at least two hydraulic lines to the riser substantially parallel to each other forming substantially unobstructed track means along the riser joint and from one joint to another for receiving a carriage adapted to run on such tracks, the riser includes a hydraulic connector and swivel assembly having retractable orienting pins adapted to be inserted into an orientation hole in said swivel assembly for orienting the riser relative to the blow-out preventer stack and means for retracting said orienting pins to permit rotation of said riser string relative to said blow-out preventer stack.

25. A method of replacing an Ax gasket between a wellhead and a wellhead connector on a sub-sea well comprising the steps of:

(a) lifting the wellhead connector off of the wellhead;
(b) releasing the Ax gasket in the wellhead connector to permit removal of the Ax gasket therefrom;
(c) manipulating a remotely operable gasket carrier having an Ax gasket mounted thereon to insert such gasket in the central opening of the wellhead connector;
(d) withdrawing said gasket carrier from the wellhead; and
(e) seating the wellhead connector on the wellhead.

* * * * *